US007784205B1

(12) United States Patent
Baron et al.

(10) Patent No.: US 7,784,205 B1
(45) Date of Patent: Aug. 31, 2010

(54) DISPLAY FOR DISPENSING MACHING

(75) Inventors: Richard D. Baron, Zephyrhills, FL (US); Steven A. Garbee, Brandon, FL (US)

(73) Assignee: Nestec S.A., Vevey (CH)

( * ) Notice: Subject to any disclaimer, the term of this patent is extended or adjusted under 35 U.S.C. 154(b) by 609 days.

(21) Appl. No.: 11/511,754

(22) Filed: Aug. 28, 2006

Related U.S. Application Data

(60) Provisional application No. 60/712,207, filed on Aug. 29, 2005, provisional application No. 60/778,218, filed on Mar. 2, 2006.

(51) Int. Cl.
*G09F 13/04* (2006.01)
*G09F 13/00* (2006.01)
*B65D 5/00* (2006.01)

(52) U.S. Cl. ..... 40/564; 40/574; 40/575; 40/576; 40/552; 222/129.1

(58) Field of Classification Search ..... 40/564, 40/574, 576, 575; 222/129.1
See application file for complete search history.

(56) References Cited

U.S. PATENT DOCUMENTS

| | | | |
|---|---|---|---|
| D73,990 | S | 11/1927 | Young |
| D133,160 | S | 7/1942 | Evans |
| D141,362 | S | 5/1945 | Elkins |
| D156,089 | S | 11/1949 | Fuerst |
| D156,279 | S | 11/1949 | Rasmusson |
| 2,554,570 | A | 5/1951 | Harvey |
| D167,991 | S | 10/1952 | Mack |
| 2,685,985 | A | 8/1954 | Howell |
| 2,702,147 | A | 2/1955 | Brown |
| 2,716,507 | A | 8/1955 | Graves |
| 2,737,880 | A | 3/1956 | Johnson |
| D178,846 | S | 9/1956 | Norris |
| 2,772,817 | A | 12/1956 | Jauch |
| 2,927,522 | A | 3/1960 | Rockwood et al. |
| D192,619 | S | 4/1962 | Mojonnier |
| D192,621 | S | 4/1962 | Mojonnier |
| D193,217 | S | 6/1962 | Cassell |
| D193,741 | S | 10/1962 | Westhoven et al. |
| D194,564 | S | 2/1963 | Mojonnier |
| D196,939 | S | 11/1963 | Cigognetti |
| D197,993 | S | 4/1964 | Mojonnier |
| D197,994 | S | 4/1964 | Mojonnier |
| D198,475 | S | 6/1964 | Mojonnier |
| 3,176,879 | A | 4/1965 | Mojonnier |
| D203,074 | S | 11/1965 | Adell |
| D206,519 | S | 12/1966 | Wolfe |
| 3,338,459 | A | 8/1967 | Smith |

(Continued)

*Primary Examiner*—Lesley Morris
*Assistant Examiner*—Syed A Islam
(74) *Attorney, Agent, or Firm*—Frijouf, Rust & Pyle, P.A.

(57) ABSTRACT

An improved display is disclosed for a dispensing machine having a plurality of switches for dispensing a plurality of products. The improved display comprises a plurality of illuminators located in proximity to the plurality of switches. A decorative panel indicates the types of the plurality of products for dispensing by the dispensing machine. A mounting fixes the decorative panel for enabling the plurality of illuminators to illuminate the decorative panel. A control is connected to the plurality of switches for energizing the plurality of illuminators in response to an actuation of a selected one of the plurality of switches for indicating the dispensing of one of the plurality of products by the dispensing machine.

1 Claim, 11 Drawing Sheets

U.S. PATENT DOCUMENTS

D209,126 S 10/1967 Martin
D209,342 S 11/1967 Thompson et al.
D211,316 S 6/1968 Kusterman et al.
D212,258 S 9/1968 Cornelius et al.
D213,040 S 12/1968 Schaper et al.
D218,019 S 7/1970 Lattrave
D218,281 S 8/1970 Diener
D221,202 S 7/1971 Lorang
D223,325 S 4/1972 Mox
D223,334 S 4/1972 Hayes et al.
D224,511 S 8/1972 Koenigsberg
D226,703 S 4/1973 Broadhead
D227,002 S 5/1973 Broadhead
3,740,231 A 6/1973 Drwal et al.
3,756,398 A 9/1973 Green et al.
3,771,432 A 11/1973 Karlen
3,793,935 A 2/1974 Martin
3,828,985 A 8/1974 Schindler
D233,081 S 10/1974 Koch et al.
D233,271 S 10/1974 Holcomb
D235,388 S 6/1975 Taylor
D236,807 S 9/1975 Schmidt
3,940,002 A 2/1976 Schiemann
3,948,105 A 4/1976 Johnson, Jr.
D241,915 S 10/1976 Campbell et al.
D242,770 S 12/1976 Mitchell
4,064,795 A 12/1977 Ackerman
D247,770 S 4/1978 Sagona
4,088,298 A 5/1978 Brown
4,155,487 A 5/1979 Blake
D254,184 S 2/1980 Martin et al.
D255,093 S 5/1980 Hartung et al.
4,228,758 A 10/1980 Dornau et al.
4,252,073 A 2/1981 Hartung et al.
4,334,640 A 6/1982 van Overbrugen et al.
D265,653 S 8/1982 Arzberger et al.
4,393,982 A 7/1983 Kuckens
D269,948 S 8/1983 Janssen
D272,976 S 3/1984 LaLumiere
D274,029 S 5/1984 Daugherty
4,579,260 A 4/1986 Young et al.
D288,531 S 3/1987 Tarasevich et al.
4,646,945 A 3/1987 Steinen et al.
D289,612 S 5/1987 Carlson
D289,976 S 5/1987 Mumpries
D294,117 S 2/1988 Rogler et al.
D294,118 S 2/1988 Papa
D294,463 S 3/1988 Lang
D294,678 S 3/1988 Papa
D295,381 S 4/1988 Papa
D296,668 S 7/1988 Stavish
4,776,495 A 10/1988 Vignot
4,779,761 A 10/1988 Rudick et al.
4,816,273 A 3/1989 Smith et al.
D302,522 S 8/1989 Charbonneau et al.
D303,083 S 8/1989 Powell et al.
4,901,878 A 2/1990 Humphries
D308,825 S 6/1990 Hoyt
4,952,068 A 8/1990 Flint
4,953,754 A 9/1990 Credle, Jr.
D315,869 S 4/1991 Collette
D319,976 S 9/1991 Wortley et al.
D320,157 S 9/1991 Nobile et al.
D320,931 S 10/1991 Siegel
D321,320 S 11/1991 Halm
D322,383 S 12/1991 Jones
5,114,047 A 5/1992 Baron et al.
5,123,575 A 6/1992 Li
5,720,480 A * 2/1998 Lawlor et al. ..... 273/118 A
6,095,056 A * 8/2000 Schumacher ..... 108/23
6,688,134 B2 * 2/2004 Barton et al. ..... 62/390
7,007,417 B2 * 3/2006 Segan et al. ..... 40/444

* cited by examiner

DISPLAY FOR DISPENSING MACHING

CROSS-REFERENCE TO RELATED APPLICATIONS

This application claims benefit of U.S. Patent Provisional application Ser. No. 60/712,207 filed Aug. 29, 2005 and U.S. Patent Provisional application Ser. No. 60/778,218 filed Mar. 2, 2006. All subject matter set forth in provisional application Ser. No. 60/712,207 and provisional application Ser. No. 60/778,218 is hereby incorporated by reference into the present application as if fully set forth herein.

BACKGROUND OF THE INVENTION

1. Field of the Invention

The invention relates to liquid dispensing and more particularly to an improved display for a dispensing machine capable of dispensing a plurality of products.

2. Background of the Related Art

Various types of liquid dispensing devices have been provided by the prior art for dispensing a liquid product. One particular type of liquid dispensing device relates to the mixing of a concentrate with a diluent for dispensing a final liquid product. In this type of liquid dispensing device, a liquid concentrate is mixed with a larger volume of liquid diluent for producing a final liquid product. Liquid dispensing devices for mixing a liquid concentrate with a liquid diluent have found widespread use for a number of applications including the mixing and dispensing a plurality of consumable liquid products.

The invention set forth in our U.S. Pat. No. 5,114,047 is a significant advancement in the dispensing of consumable liquid from a concentrate. U.S. Pat. No. 5,114,047 discloses a pump and mixing device for pumping a liquid concentrate from a container and mixing the liquid concentrate with a diluent. The pump and mixing device comprises a body member having an input body portion and an output body portion with a flexible wall defining a pumping chamber between the input body portion and the output body portion. The input body portion has an input aperture for enabling the liquid to flow from the container into the input body portion. The output body portion has an output aperture communicating with the flowing diluent. An input one-way valve is disposed in the input aperture for permitting the flow of liquid only from the container to the pumping chamber whereas an output one-way valve is disposed in the output aperture for permitting the flow of liquid only from the pumping chamber. A motive device reciprocates the output body portion relative to the input body portion between a first and a second position for causing liquid to flow from the container through the input one-way valve into the pumping chamber when the output body portion is moved into the first position and for causing liquid to flow from the pumping chamber through the output one-way valve to mix with the diluent when the output body portion is moved into the second position.

U.S. Pat. No. 5,114,047 was reduced to practice in a beverage vending machine for mixing a plurality of concentrates with a diluent for dispensing a plurality of consumable liquid products. The beverage vending machine mixed various liquid concentrates with a water diluent to provide a plurality of different consumable liquid products. The beverage vending machine manufactured under U.S. Pat. No. 5,114,047 found rapid substantial commercial success.

Although the beverage vending machine manufactured under U.S. Pat. No. 5,114,047 remains a successful commercial product to the present day, it would be desirable to improve the display of the plurality of different consumable liquid products dispensed by the beverage vending machine.

Therefore it is an object of this invention to provide a display for a dispensing machine that improves upon our prior inventions.

Another object of this invention is to provide a display for a dispensing machine that is capable of simultaneously displaying all of the plurality of different consumable liquid products dispensed by the dispensing machine.

Another object of this invention is to provide a display for a dispensing machine that is capable of individually displaying all of the plurality of different consumable liquid products dispensed by the dispensing machine.

Another object of this invention is to provide a display for a dispensing machine incorporating a programmable illumination panel for illuminating the display for the dispensing machine.

Another object of this invention is to provide a display for a dispensing machine that may be retrofitted into dispensing machine of the prior art.

Another object of this invention is to provide a display for a dispensing machine that is inexpensive to add to beverage vending machines.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved display for a dispensing machine having a plurality of switches for dispensing a plurality of products. The improved display comprises a plurality of illuminators located in proximity to the plurality of switches. A decorative panel indicates the types of the plurality of products for dispensing by the dispensing machine. A mounting fixes the decorative panel for enabling the plurality of illuminators to illuminate the decorative panel. A control is connected to the plurality of switches for controlling the plurality of illuminators in response to an actuation of a selected one of the plurality of switches for indicating the dispensing of one of the plurality of products by the dispensing machine.

In a more detailed embodiment of the invention, the dispensing machine includes a plurality of nozzles for dispensing a plurality of beverages. The plurality of switches are located adjacent to the plurality of nozzles. Similarly, the plurality of switches are located adjacent to the plurality of illuminators.

Preferably, each of the plurality of illuminators includes a multiplicity of light solid state illuminators. In one example, each of the plurality of illuminators includes a multiplicity of light emitting diodes arranged in an array.

Preferably, the decorative panel is translucent for enabling the plurality of illuminators to illuminate through the decorative panel. In one embodiment, the decorative panel overlays the plurality of illuminators for indicating the types of the plurality of products. In another embodiment, the decorative panel includes a plurality of sections for overlaying the plurality of illuminators for indicating each type of the plurality of products, respectively. Each of the plurality of sections has individual graphics for indicating each type of the plurality of products.

The mounting removably fixes the decorative panel to the dispensing machine for enabling the decorative panel to be change upon a change of the plurality of products. In one example of the invention, the mounting decorative panel includes a first and a second interchangeable panel. The first interchangeable panel has a single section for overlying the plurality of illuminators for indicating the types of the plurality of products. The second interchangeable panel has a plurality of sections for overlying the plurality of illuminators for indicating each type of the plurality of products, respectively. The mounting removably fixes one of the first and second interchangeable panels to the dispensing machine and for enabling the first and second interchangeable panels to be changed upon a change of the plurality of products. The mounting may include a transparent lens for covering the decorative panel.

The control energizes the plurality of illuminators in response an actuation of one of the plurality of switches for indicating the dispensing of one of the plurality of products by the dispensing machine. In the alternative, the control energizes one of the plurality of illuminators in response an actuation of a selected one of the plurality of switches for indicating the dispensing of a selected type of the plurality of products by the dispensing machine.

The control may include a programmable memory for storing an illumination sequence for the plurality of illuminators. The control energizes the plurality of illuminators in the illumination sequence during non-actuation of the plurality of switches.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
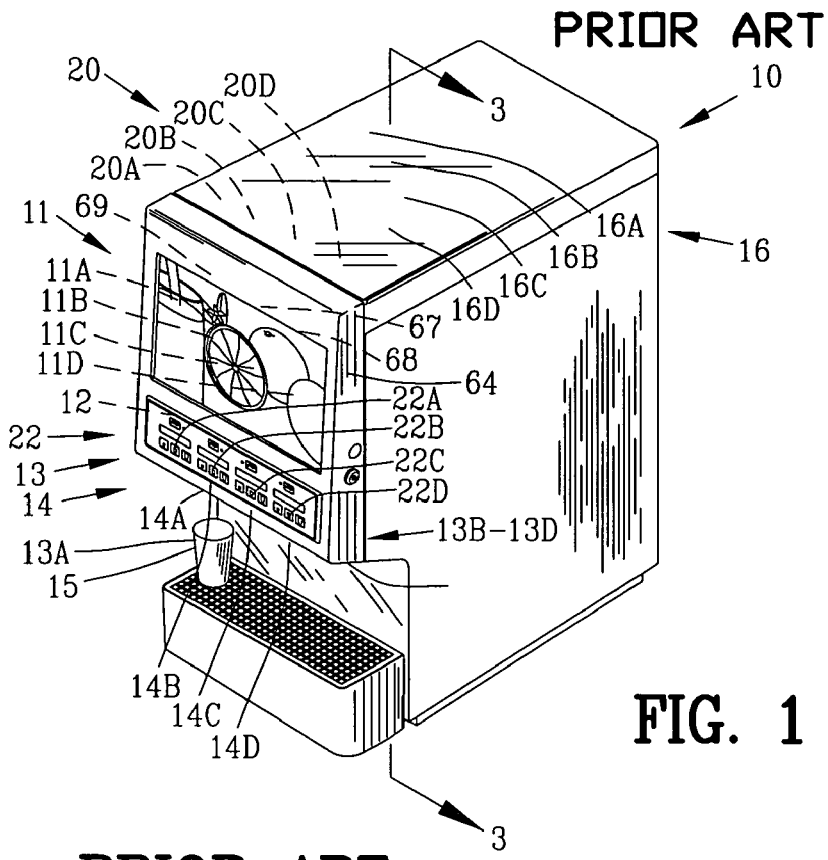
FIG. 1 is an isometric view of a dispenser system of the prior art.

FIG. 1 is an isometric view of a prior art dispenser device 10 for pumping a first liquid 11 and a second liquid 12. The dispenser device 10 mixes the first liquid 11 and the second liquid 12 to provide a mixed product 13 for discharge from a discharge aperture 14 into a vessel shown as a cup 15. In this example, the first liquid 11 is a first liquid concentrate 11 and the second liquid 12 is a second liquid diluent 12. Preferably, the second liquid diluent 12 is potable water.

The dispenser device 10 includes a pump and mixing device 20 controlled by an operator switch 22. Upon actuation of the operator switch 22, the pump and mixing device 20 pumps the first liquid concentrate 11 to mix with the second liquid diluent 12. The mixed first liquid concentrate 11 and the second liquid diluent 12 are discharged as the mixed product 13 from the discharge aperture 14 of the pump and mixing device 20.

In this specific example, the prior art dispenser device 10 includes four concentrate containers 16A-16D for storing four separate first liquid concentrates 11A-11D. The dispenser 10 includes four separate pump and mixing devices 20A-20D controlled by four separate operator switches 22A-22D. The pump and mixing devices 20A-20D pump the four separate first liquid concentrates 11A-11D to mix with the common second liquid diluent 12 to provide four separate mixed products 13A-13D. The four separate mixed products 13A-13D are discharged from four separate discharge apertures 14A-14D. The discharge apertures 14A-14D are located adjacent to the operator switches 22A-22D, respectively.

Figure 2:
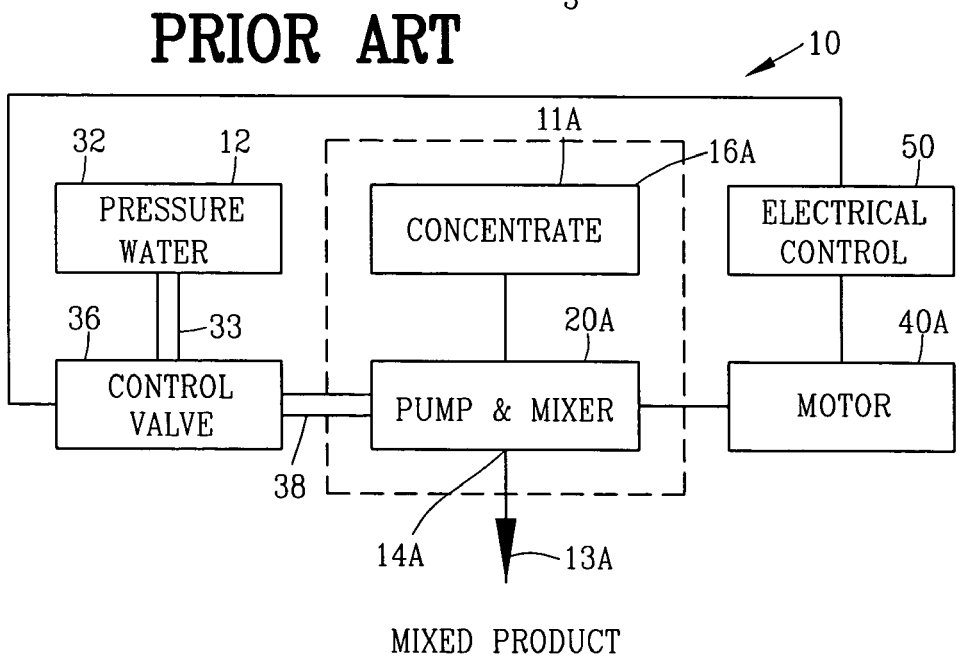
FIG. 2 is a block diagram of the dispenser system of FIG. 1.

FIG. 2 is a block diagram illustrating the mechanism of the dispenser device 10 of the pump and mixing device 20A of FIG. 1. The concentrate container 16A communicates with the pump and mixing device 20A for enabling the pump and mixing device 20A to pump the first liquid concentrate 11A. A pressurized source 32 of the second liquid diluent 12 is connected through a conduit 33 and a control valve 36 and conduit 38 to the pump and mixing device 20A. A motor 40A is connected to the pump and mixing device 20A for driving the pump and mixing device 20A.

An electrical control 50 is connected to operate the control valve 36 and the motor 40A. Upon actuation of the switch 22A, the second liquid diluent 12 flows through the water valve 36 and conduit 38 into the pump and mixing device 20A. Simultaneously, the pump and mixing device 20A pumps the first liquid concentrate 11A from the concentrate container 16A. The movement of the pump and mixing device 20A by the motor 40A pumps and mixes the first liquid concentrate 11A with the second liquid diluent 12 to discharge the mixed product 13A from the discharge aperture 14A.

Figure 3:
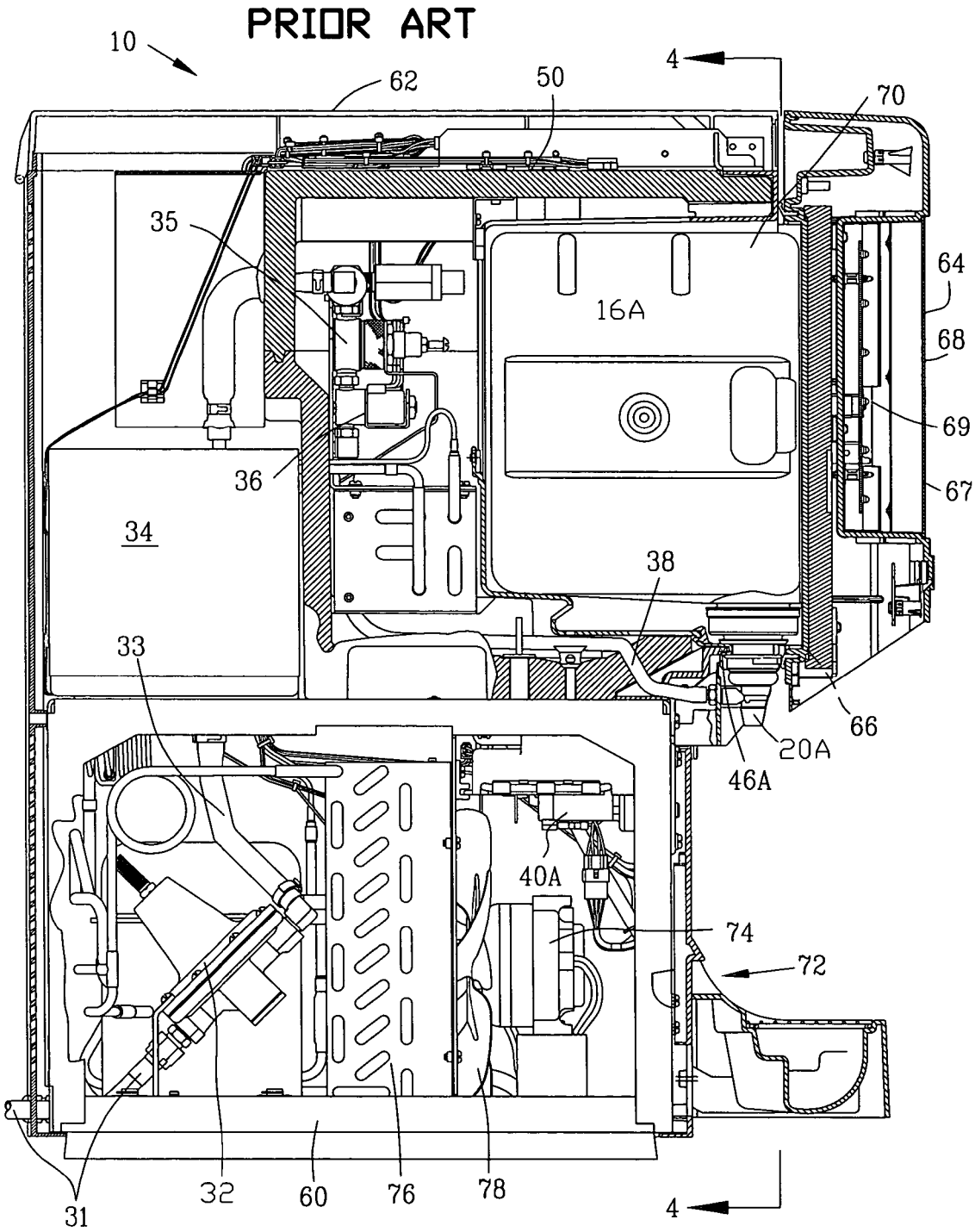
FIG. 3 is a sectional view along line 3-3 in FIG. 1.
Figure 4:
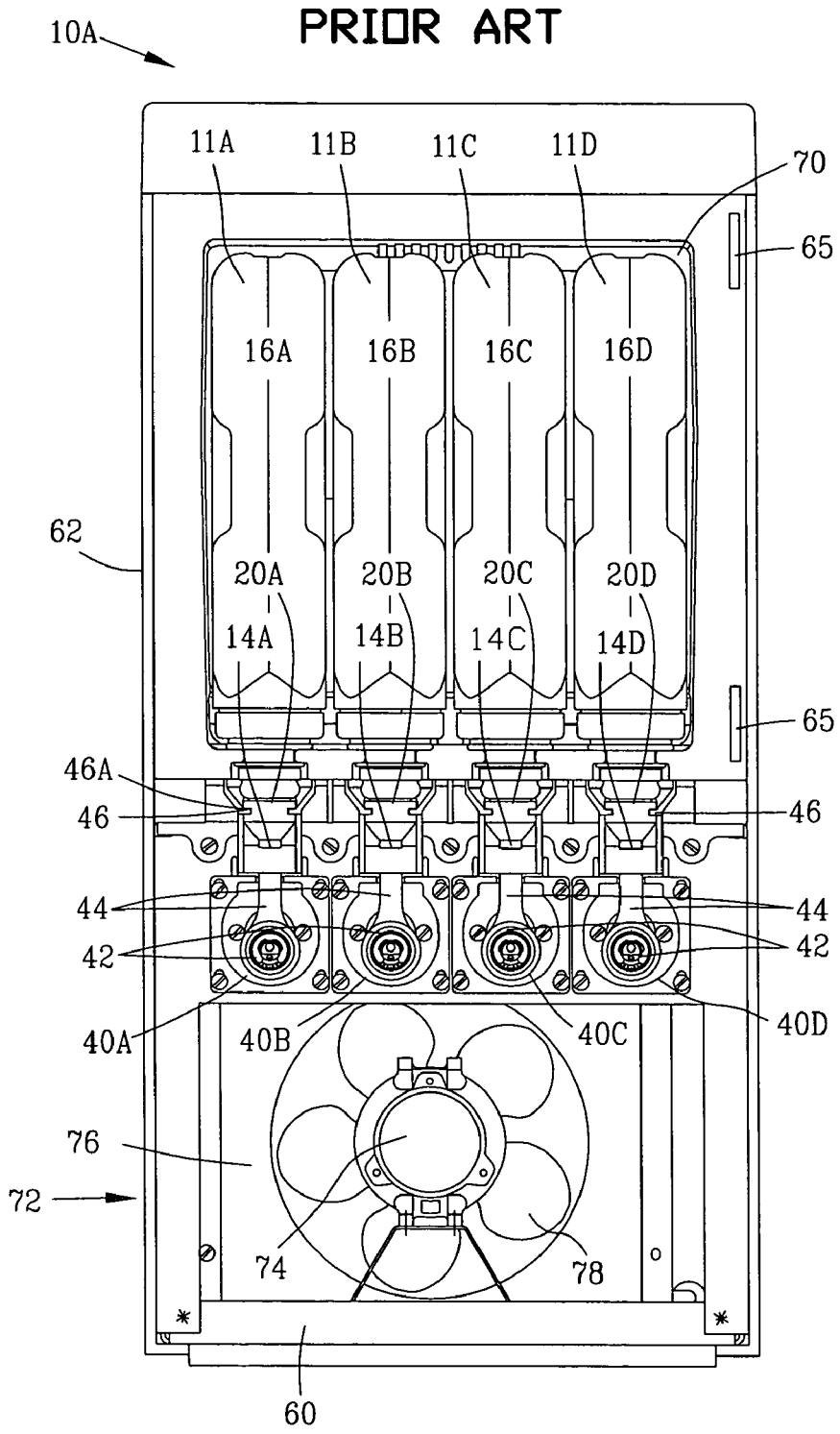
FIG. 4 is a sectional view along line 4-4 in FIG. 3.

FIGS. 3 and 4 are enlarged sectional views illustrating the interior of the dispenser device 10 shown in FIG. 1. The dispenser device 10 comprises a frame 60 for supporting various components of the dispenser device 10 including an outer covering shroud 62. A front door 64 is pivotably mounted to the frame 60 by hinges 65 for enabling an operator to access an interior of the dispenser device 10. The front door 64 includes a front door bottom 66.

A translucent decorative panel 67 is affixed to the front door 64. The translucent decorative panel 67 has graphics 68 for indicating the types of the plurality of the mixed product 13A-13D. A conventional light source 69 is located behind the translucent decorative panel 67 for illuminating the graphics 68 on the translucent decorative panel 67.

The second liquid diluent 12 shown as water enters under conventional water pressure through an input conduit 31. The input conduit 31 is connected through a liquid pressure regulator 32 and a conduit 33 to a reservoir 34. A circulating pump 35 circulates the second liquid diluent 12 between the reservoir 34 and a refrigerated compartment 70 for maintaining the second liquid diluent 12 at a proper temperature for use. The control valve 36 controls the flow of the second liquid diluent 12 from the reservoir 34 to pumping and mixing devices 20A-20D through the flexible conduit 38.

A refrigeration unit 72 maintains the refrigerated compartment 70 at a reduced temperature. The refrigeration unit 72 includes a motor 74, a compressor 76 and a fan 78 connected in a conventional arrangement.

The pump and mixing devices 20A-20D are connected to the concentrate containers 16A-16D. The concentrate containers 16A-16D and the attached pump and mixing devices 20A-20D are loaded into and removed from the refrigerated compartment 70 through the front door 64. The refrigerated compartment 70 maintains the first liquid concentrates 11A-11D at a proper temperature for storage and use.

The pumping motors 40A-40D include eccentrics 42 for reciprocating driving arms 44. The reciprocating driving arms 44 are connected through coupling devices 46 to operate the pump and mixing devices 20A-20D.

When the concentrate containers 16A-16D and the attached pump and mixing devices 20A-20D are inserted within the refrigerated compartment 70 the attached pump and mixing devices 20A-20D are connected simultaneously to the conduit 38 and to the coupling devices 46.

The electrical control 50 operates the dispenser device 10 in response to the operator switches 22A, 22B, 22C and 22D. Upon activation of one of the operator switches 22A, 22B, 22C and 22D, the electrical control 50 energizes flow control valve 38 and a selected one of the operator switches 22A, 22B, 22C and 22D for mixing the liquid diluent 12 with a selected one of the concentrates first liquid concentrates 11A-11D from the containers concentrate containers 16A-16D to produce the mixed product 13.

The prior art dispenser device 10 shown in FIGS. 1-4 is set forth in U.S. Pat. No. 5,114,047 entitled Pump and Mixing Device for Liquids issued to Richard D. Baron et al which is incorporated by reference into the present application as if fully set forth herein. Although the present invention is set forth with reference to the prior art dispenser device 10 shown in U.S. Pat. No. 5,114,047, it should be understood that the present invention may be used with other types, styles and configurations of dispenser devices.

Figure 5:
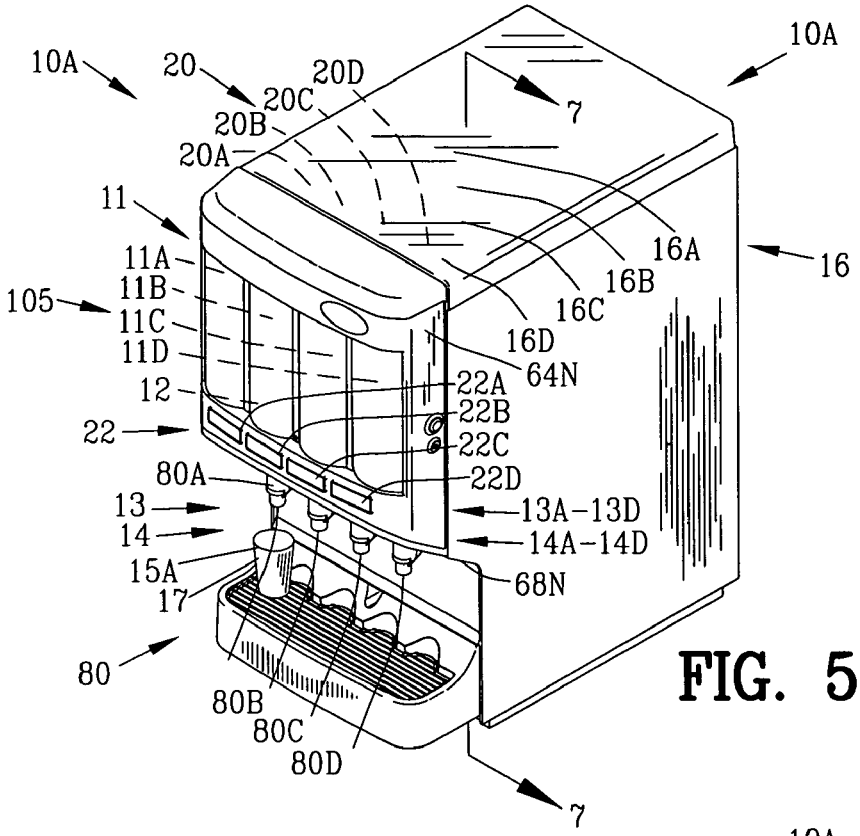
FIG. 5 is an isometric view of a dispenser system similar to the prior art dispenser in FIG. 1 incorporating the improved display of the present invention.

FIG. 5 is an isometric view of the improved display 105 of the present invention incorporated into the dispenser device 10A similar to the prior art dispenser device 10 shown in FIGS. 1-4. In this example, the dispenser device 10A is provided with a new or upgraded front door 64N from the dispenser device 10 shown in FIG. 1. The new or upgraded front door 64N includes the improved display 105 as well as a novel terminal orifice processor 80. The novel terminal orifice processor 80 is the subject matter of a copending application filed in the U.S. Patent Office under Ser. No. 60/712,207 on Aug. 29, 2005 the subject matter of which is incorporated by reference into the present specification as if fully set forth set forth herein.

Figure 7:
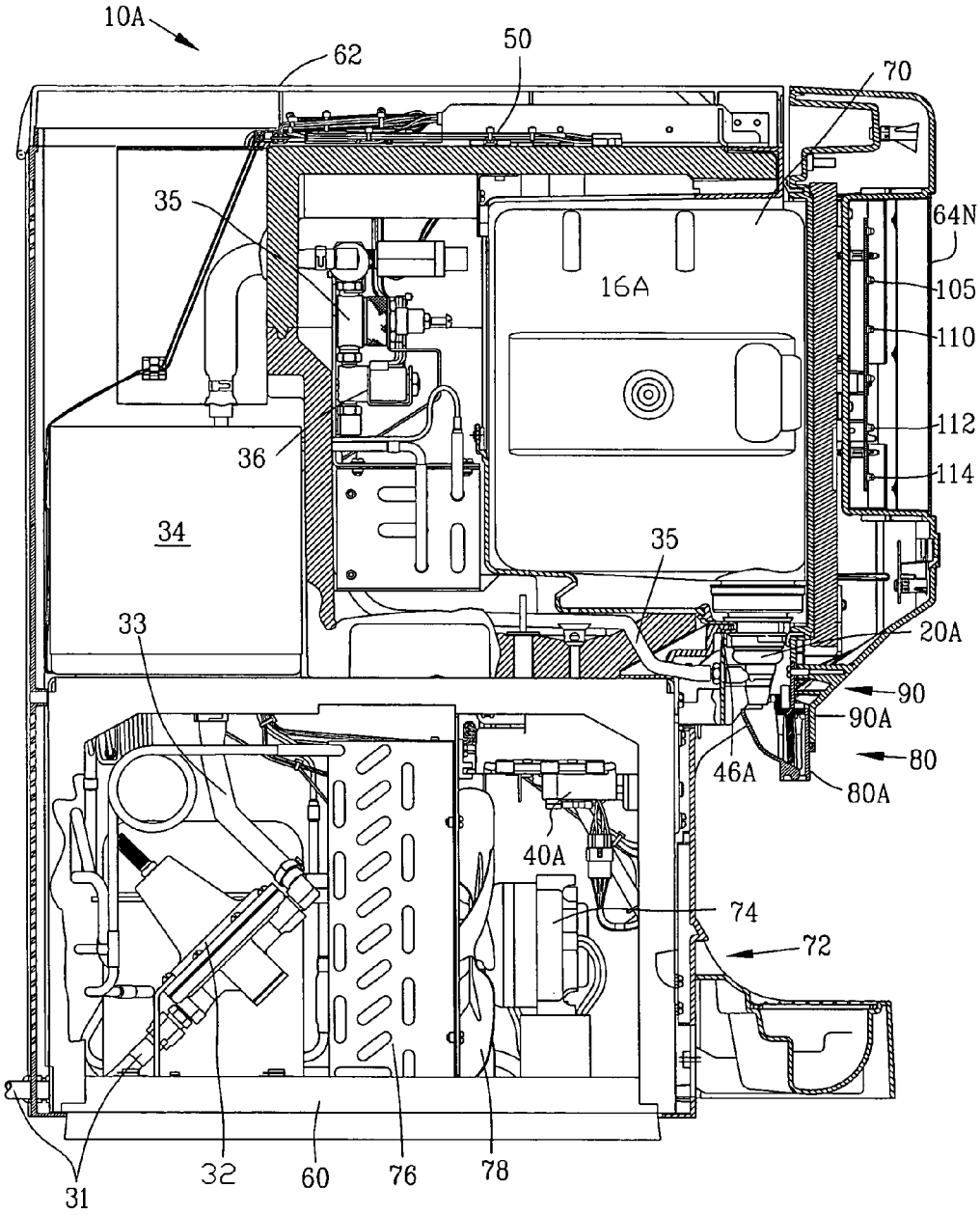
FIG. 7 is a sectional view along line 7-7 in FIG. 5.

FIG. 7 is a sectional view along line 7-7 in FIG. 5. A connector 90 secures the terminal orifice processor 80 below the discharging aperture 14 of the pump and mixing device 20. Terminal orifice processors 80A-80D are mounted adjacent to the discharging apertures 14A-14D of the pump and mixing devices 20A-20D by connectors 90A-90D. The discharge apertures 14A-14D are located adjacent to the operator switches 22A-22D, respectively.

Figure 6:
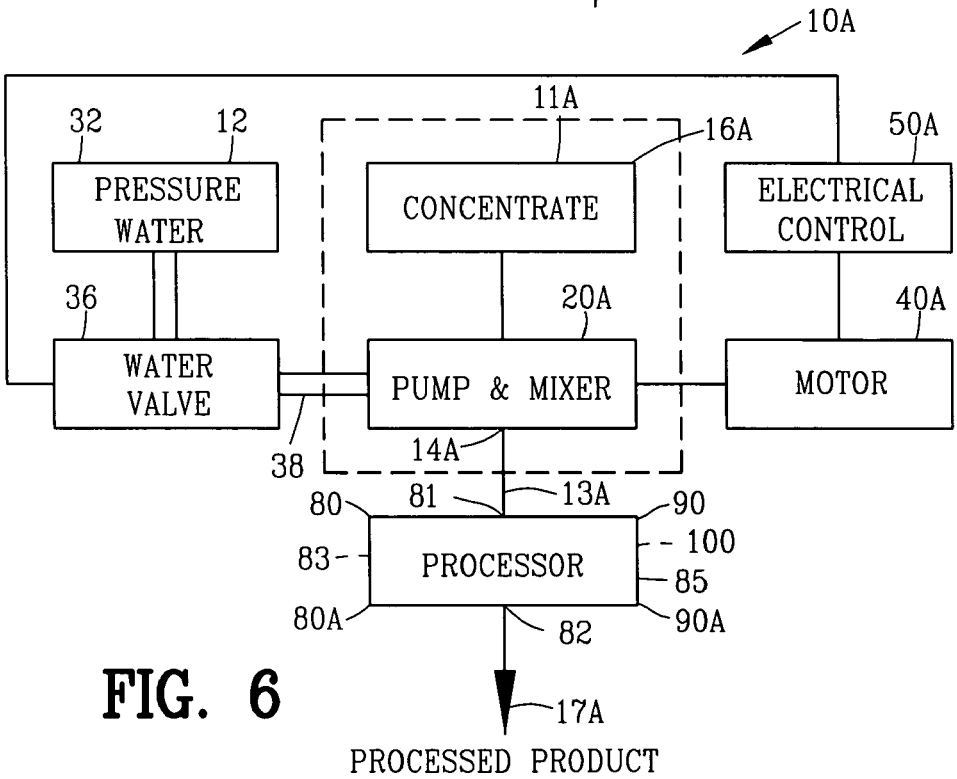
FIG. 6 is a block diagram of the dispenser system of FIG. 5.

FIG. 6 is a block diagram similar to FIG. 2 illustrating the improved terminal orifice processor 80A with the pump and mixing device 20A of the prior art dispenser device 10. The terminal orifice processor 80 includes an input orifice 81 and a terminal orifice 82 interconnected by a processing channel 83. The input orifice 81, terminal orifice 82 and processing channel 83 are defined within a housing 85. An optional insert 100 may be located within the processing channel 83.

The pump and mixing device 20A operates in the same manner as set forth with reference to FIG. 2. Upon actuation of the switch 22A, the second liquid diluent 12 flows through the water valve 36 and the conduit 38 into the pump and mixing device 20A. The pump and mixing device 20A pumps the first liquid concentrate 11A from the concentrate container 16A. The movement of the pump and mixing device 20A by the motor 40A pumps and mixes the first liquid concentrate 11A with the second liquid diluent 12 and discharge the mixed product 13A from the discharge aperture orifice 14A.

The mixed product 13A moves by action of gravity into the input orifice 81 of the terminal orifice processor 80. The flow of the mixed product 13A through the processing channel 83 enhances the characteristic of the mixed product 13A into a processed product 17A. The processed product 17A is discharged from the terminal orifice 82 of the terminal orifice processor 80 into the cup 15 with enhanced discharge characteristics.

Figure 8:
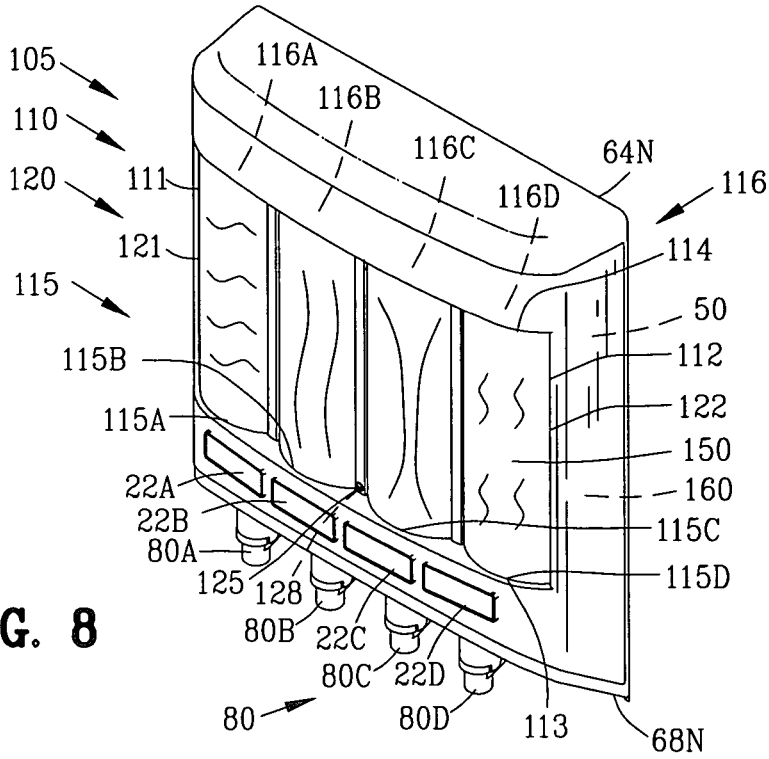
FIG. 8 is an enlarged isometric view of the first embodiment of the improved display for dispensing machine shown in FIG. 5.
Figure 9:
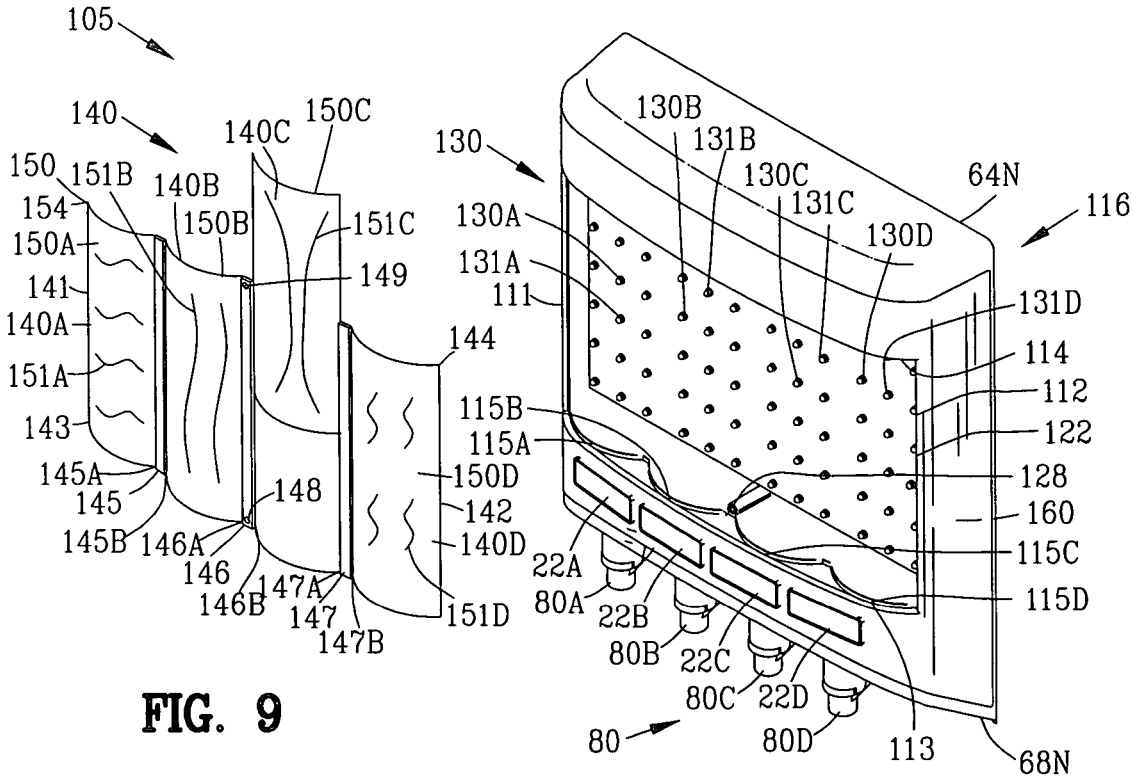
FIG. 9 is an exploded view of the improved display of FIG. 9.

FIGS. 8 and 9 are enlarged isometric and exploded views of the first embodiment of the improved display 105 for the dispensing machine 10A shown in FIGS. 5-7. The improved display 105 comprises a display window 110 incorporating a mounting 120. A plurality of arrays 130 of illuminators are located within the display window 110 and are covered by a transparent lens 140. A decorative panel 150 is secured within the display window 110 of the front door 64N by the mountings 120 and the transparent lens 140. The plurality of arrays 130 of illuminators are actuated by a controller 160.

Figure 10:
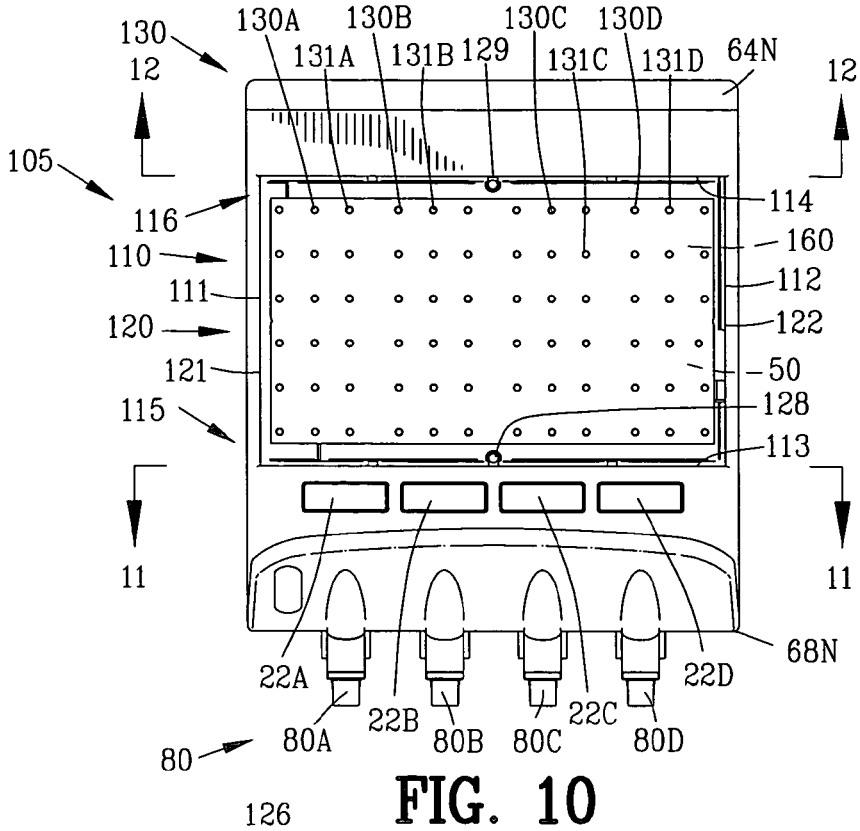
FIG. 10 is a front view similar to FIG. 8 with the display panel removed.
Figure 11:
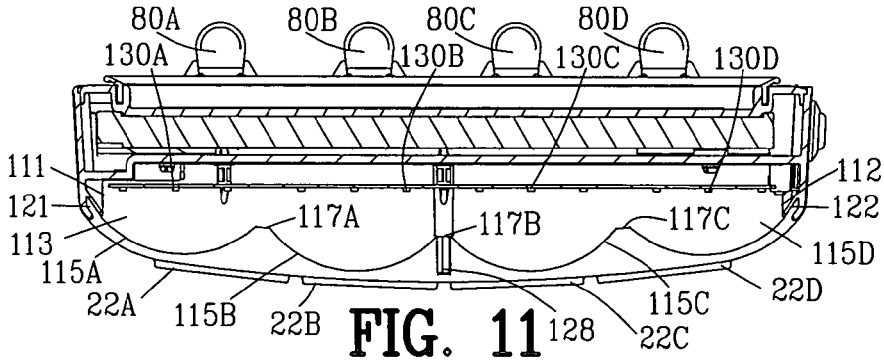
FIG. 11 is a sectional view along line 11-11 in FIG. 10.
Figure 12:
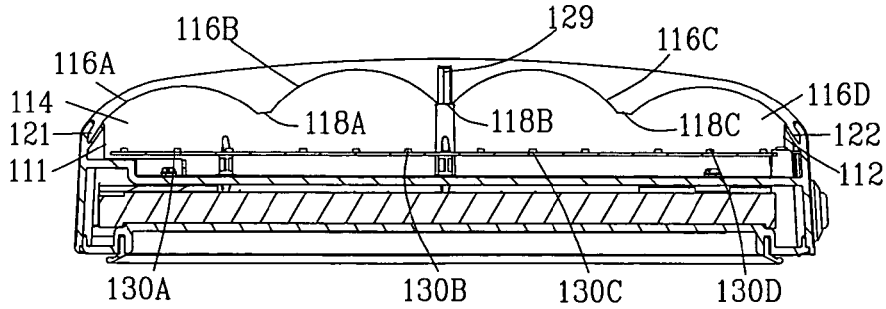
FIG. 12 is a sectional view along line 12-12 in FIG. 10.

FIGS. 10-12 are front and sectional views of the improved display 105 of FIG. 8 with the transparent lens 140 and the decorative panel 150 being removed from the display window 110.

The display window 110 of the front door 64N comprises a first and a second side edge 111 and 112 and a lower and an upper edge 113 and 114. Lower shoulders 115 and upper shoulders 116 are located on the lower and upper edges 111 and 112 of the display window 110. The lower shoulders 115 comprise a plurality of lower arcuate shoulders 115A-115D. In a similar fashion, the upper shoulders 116 comprise a plurality of upper arcuate shoulders 116A-116D. A plurality of lower separators 117A-117C are interposed between the plurality of lower arcuate shoulders 115A-115D whereas a plurality of upper separators 118A-118C are interposed between the plurality of upper arcuate shoulders 116A-116D.

The mounting 120 is adapted to removably receive the transparent lens 140 and the decorative panel 150. The mounting 120 comprises a first and a second groove 121 and 122 located at the first and second edges 111 and 112 of the display window 110. The mounting 120 includes mechanical fasteners 125 and 126 for engagement with lower and upper threaded apertures 128 and 129 located intermediate the first and second edges 111 and 112 of the display window 110 and located in proximity to the lower and upper edges 111 and 112 of the display window 110.

The plurality of arrays 130 include arrays 130A-130D located in proximity to the plurality of switches 22A-22D. Each of the plurality of arrays 130 includes a multiplicity of solid-state illuminators shown as a multiplicity of light emitting diodes 131A-131D arranged in the arrays 130A-130D. Preferably, the arrays 130A-130D of the multiplicity of solid-state illuminators 131A-131D are arranged to provide substantially uniform illumination for the decorative panel 150. As will be described in greater hereinafter, the plurality of arrays 130 are actuated by the electronic controller 160 located on the electrical control 50A.

A first embodiment of the transparent lens 140 and the decorative panel 150 is shown in FIGS. 8-15 whereas a second embodiment of the transparent lens 140E and the decorative panel 150E is shown in FIGS. 16-20. The first embodiment of the transparent lens 140 and the decorative panel 150 is interchangeable with the second embodiment of the transparent lens 140E and the decorative panel 150E.

The first embodiment of the transparent lens 140 and the decorative panel 150 have a plurality of sections 150A-150D whereas the second embodiment of the transparent lens 140E and the decorative panel 150E have a single section. The transparent lens 140 removably fixes the decorative panel 150 to the dispensing machine 10A for enabling the decorative panel 150 to be change upon a change of the plurality of products 17A-17D The spacing and intensity of each of the solid state illuminators 131A-131D of each of the plurality of arrays 130A-130D provide a uniform illumination for the both the first embodiment of the transparent lens 140 and the decorative panel 150 and the second embodiment of the transparent lens 140E and the decorative panel 150E have a single section.

Figure 13:
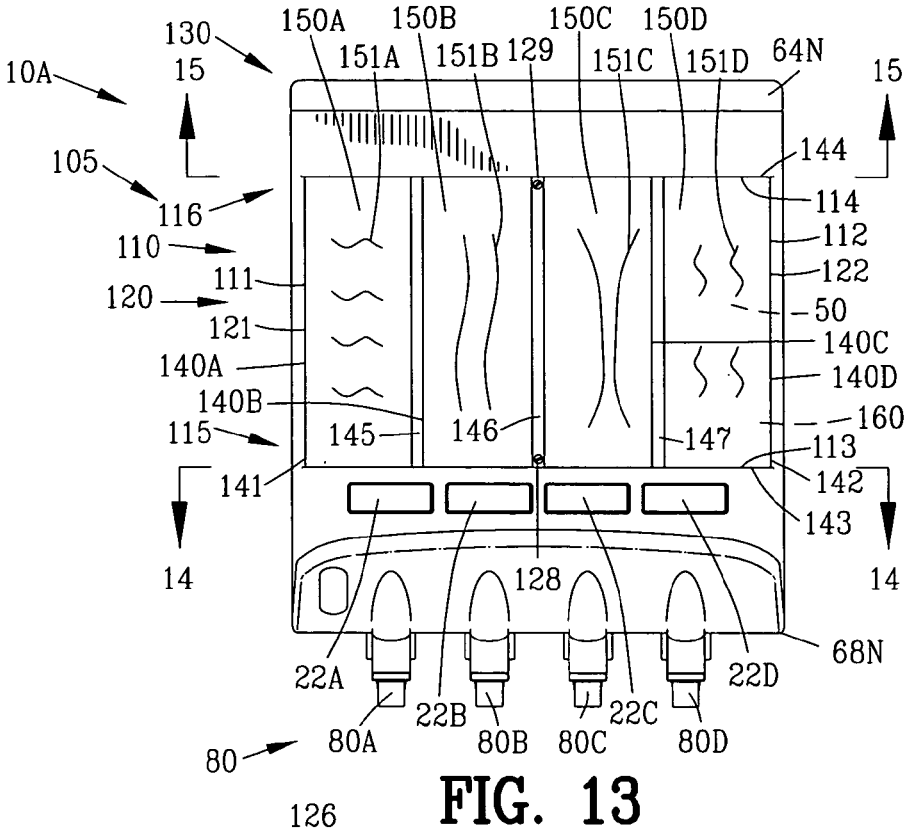
FIG. 13 is a front view of the improved display of FIG. 8 including the display panel.
Figure 14:
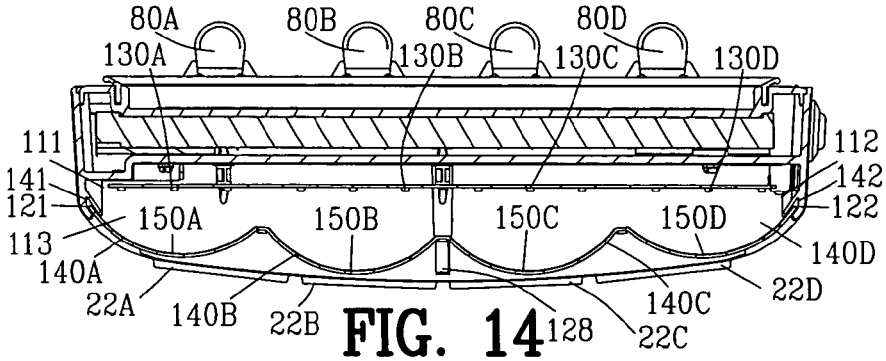
FIG. 14 is a sectional view along line 14-14 in FIG. 13.
Figure 15:
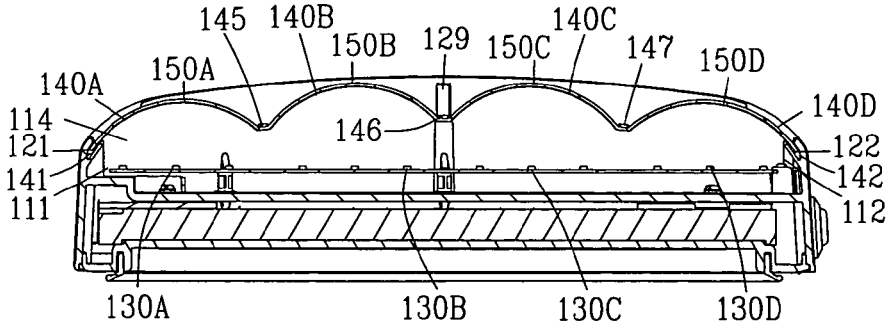
FIG. 15 is a sectional view along line 15-15 in FIG. 13.

FIGS. 13-15 are front and sectional views of the improved display 105 of FIG. 8 with the transparent lens 140 and the decorative panel 150 secured to the display window 110 by the mounting 120. The transparent lens 140 is defined by a first and a second edge 141 and 142 and a lower and an upper edge 143 and 144. In this embodiment of the invention, the transparent lens 140 comprises a plurality of partially cylindrical sections 140A-140D arranged in a generally parallel configuration. The plurality of partially cylindrical sections 140A-140D are contoured to engage with the plurality of lower and upper arcuate shoulders 115A-115D and 116A-116D.

As best shown in FIG. 9, a plurality of bars 145-147 are interposed between the plurality of partially cylindrical sections 140A-140D. The bar 145 defines a plurality of slots 145A and 145B, the bar 146 defines a plurality of slots 146A and 146B and the bar 147 defines a plurality of slots 147A and 147B. A lower and an upper aperture 148 and 149 are defined in the bar 146 to be in alignment with the apertures 123 and 124 of the mounting 120.

The transparent lens 140 is secured within the display window 110 by flexing the transparent lens 140 to insert the first and second edges 141 and 142 of the transparent lens 140 into the first and second grooves 121 and 122 of the mounting 120. The mechanical fasteners 125 and 126 are inserted through the lower and an upper apertures 148 and 149 in the bar 146 of the transparent lens 140 to thread ably engage with the threaded apertures 128 and 129 of the display window 110. The plurality of partially cylindrical sections 140A-140D engage with the plurality of lower and upper arcuate shoulders 115A-115D and 116A-116D of the display window 110.

In this embodiment, the decorative panel 150 is shown as a plurality of individual decorative panels 150A-150B for insertion upon the plurality of partially cylindrical sections 140A-140D of the transparent lens 140. Preferably, each of the plurality of decorative panels 150A-150B comprises a resilient flat sheet of water resistant material. Each of the plurality of decorative panels 150A-150B includes a decorative graphic 151A-151D. The decorative graphic 151A-154D may include graphic illustrations and/or graphic lettering representative of the processed product 17A-17D.

FIG. 9 illustrates the decorative panel 150C being slid upwardly relative to the transparent lens 140 to illustrate and distinguish the decorative panel 150C from the partially cylindrical section 140C of the transparent lens 140.

The individual decorative panels 150A-150B are inserted upon the plurality of partially cylindrical 140A-140D of the transparent lens 140 by bending and inserting the opposed edges of each the decorative panels 150A-150B into adjacent grooves 121 and 122 and/or adjacent slots 145A, 145B, 146A, 146B, 147A and 147B.

More specifically, the decorative panel 150A is secured by inserting the opposed edges of the decorative panel 150A into groove 121 of the mounting 120 and the slot 145A of the transparent lens 140. The decorative panel 150B is secured by inserting the opposed edges of the decorative panel 150B into slots 145B and 146A. The decorative panel 150C is secured by inserting the oppose edges of the decorative panel 150C into slots 146B and 147A. The decorative panel 150D is secured by inserting the oppose edges of the decorative panel 150D the slot 147B and groove 122 of the mounting 120.

The plurality of decorative panels 150A-150D overlaying the plurality of illuminators 130A-130D enables each of the plurality of decorative panels 150A-150D to be individually lighted by one of the plurality of illuminators 130A-130D.

The decorative panels 150A-150D are translucent, or partially translucent for enabling the plurality of illuminators 130A-130D to illuminate through each of the plurality of decorative panels 150A-150D of the decorative panel 150. The illumination through the plurality of decorative panels 150A-150D of the decorative panel 150 highlights the graphics 151A-151D corresponding to the processed products 17A-17D being dispensed by the terminal orifice processors 80A-80D adjacent to the plurality of operator switches 22A-22D.

Figure 16:
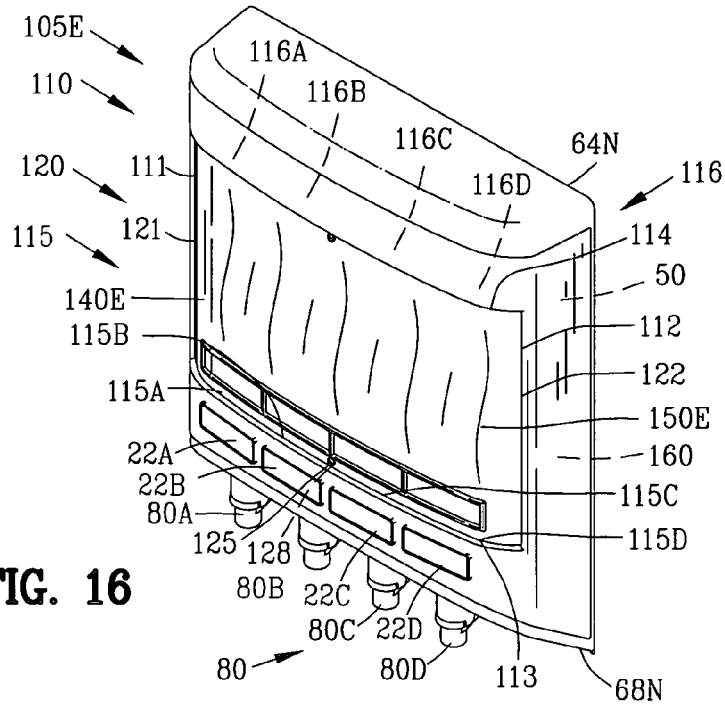
FIG. 16 is an enlarged isometric view of the second embodiment of the improved display for dispensing machine shown in FIG. 5.
Figure 17:
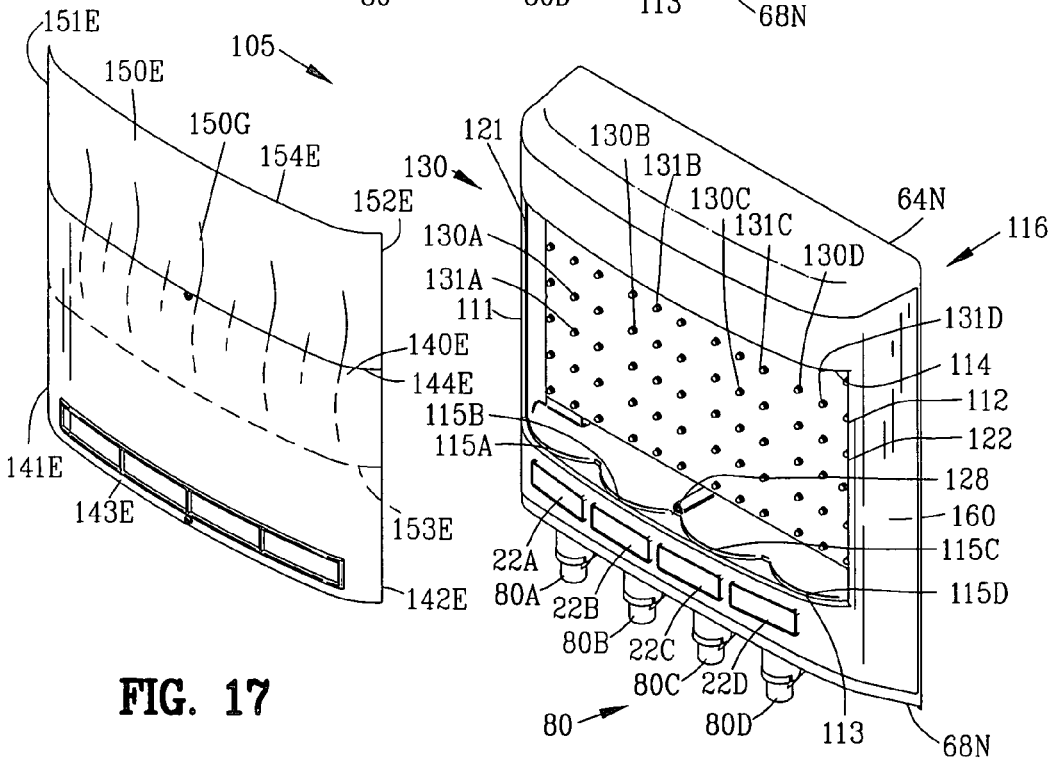
FIG. 17 is an exploded view of the improved display of FIG. 16.

FIGS. 16 and 17 are enlarged isometric and exploded views of the second embodiment of the improved display 105E for the dispensing machine 10A shown in FIGS. 5-7. In the second embodiment of the invention, the transparent lens 140E and the decorative panel 150E have a single section.

Figure 18:
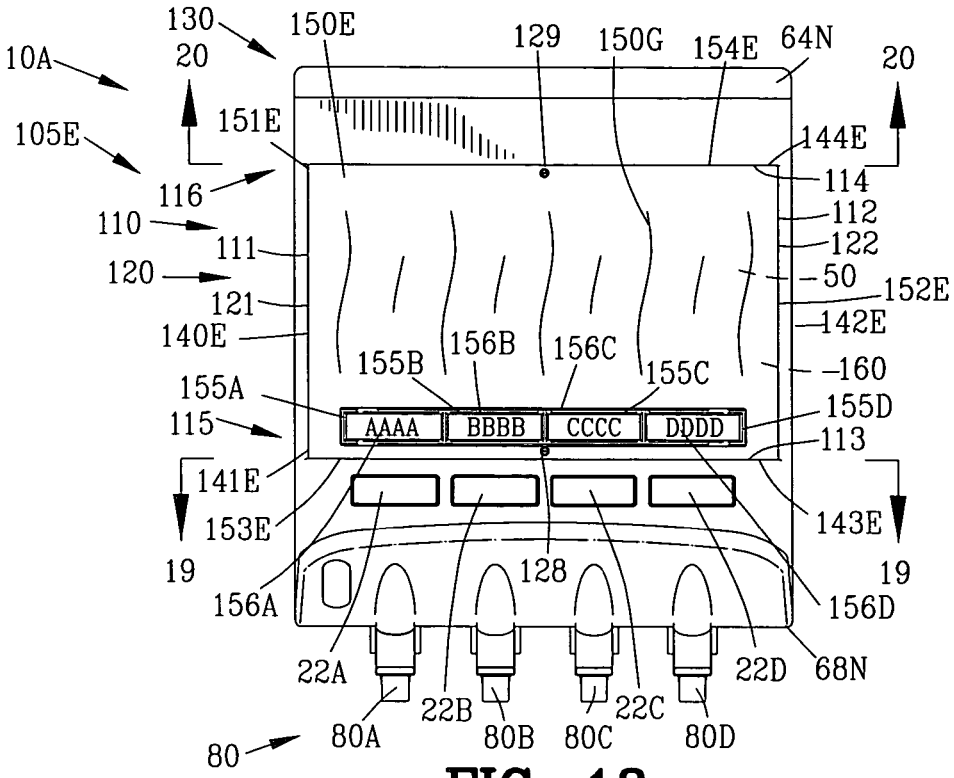
FIG. 18 is a front view of the improved display of FIG. 16.
Figure 19:
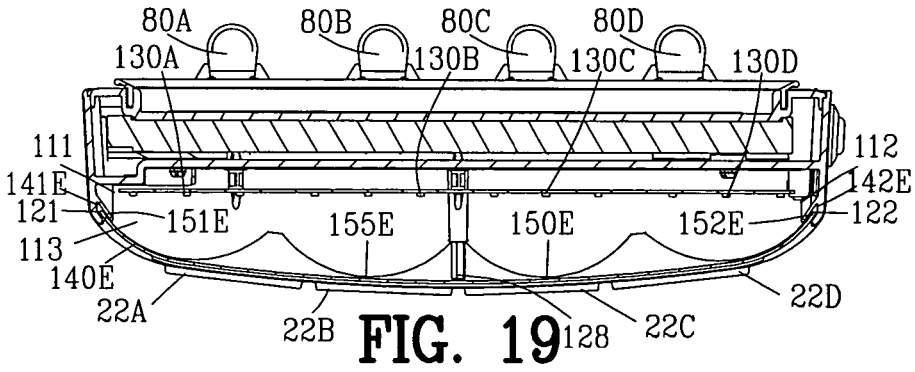
FIG. 19 is a sectional view along line 19-19 in FIG. 18.
Figure 20:
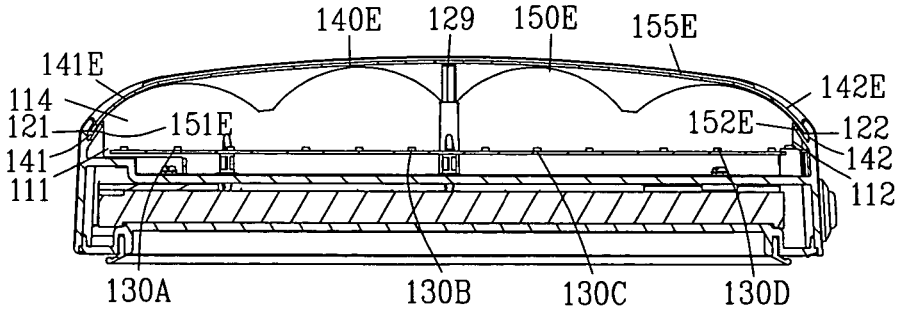
FIG. 20 is a sectional view along line 20-20 in FIG. 18.

FIGS. 18-20 are front and sectional views of the improved display 105E of FIGS. 16 and 17. The display window 110 including the mounting 120 and the plurality of arrays 130 of illuminators are identical to FIGS. 8-15.

The transparent lens 140E and the decorative panel 150E are secured within the display window 110 of the front door 64N by the mountings 120. The plurality of arrays 130 of illuminators are actuated by a controller 160.

The transparent lens 140E is defined by a first and a second edge 141E and 142E and a lower and an upper edge 143E and 144E. In this embodiment of the invention, the transparent lens 140 comprises a single arcuate section having contoured first and second edges 141E and 142 for intermittently engaging with the plurality of lower and upper arcuate shoulders 115A-115D and 116A-116D.

The transparent lens 140E includes a plurality of receivers 155A-155D located in proximity to the plurality of switches 22A-22D. The plurality of receivers 155A-155D are adapted to receive a plurality of labels 156A-156D for indicating the processed products 17A-17D being dispensed by the terminal orifice processors 80A-80D adjacent to the plurality of operator switches 22A-22D.

In this embodiment, the decorative panel 150E is defined by a first and a second edge 151E and 152E and a lower and an upper edge 153E and 154E. Preferably, the decorative panel 150E comprises a resilient flat sheet of water resistant material. The decorative panel 150E includes a decorative graphic 150G. The decorative graphic may include graphic illustrations and/or graphic lettering representative of the mixed products 17A-17D.

FIG. 17 illustrates the decorative panel 150E being slid upwardly relative to the transparent lens 140E to illustrate and distinguish the decorative panel 150E from the transparent lens 140E. The decorative panel 150E is translucent, or partially translucent for enabling the plurality of illuminators 130A-130D to illuminate through the decorative panel 150E. The illumination through the decorative panel 150E highlights the graphics 150G.

The decorative panel 150E is mounted to the display window 110 through the mounting 120 and the transparent lens 140E. The decorative panel 150E is placed under the transparent lens 140E. The transparent lens 140E and the underlying decorative panel 150E are secured within the display window 110 by flexing the transparent lens 140E and the decorative panel 150E and simultaneously inserting the first and second edges 141E and 142E of the transparent lens 140E and the first and second edges 151E and 152E of the decorative panel 150E into the first and second grooves 121 and 122 of the mounting 120. The mechanical fasteners 125 and 126 are inserted through the lower and upper apertures 148 and 149 of the transparent lens 140E to threadably engage with the threaded apertures 128 and 129 of the display window 110. The decorative panel 150E is positioned between the transparent lens 140E and the plurality of lower and upper arcuate shoulders 115A-115D and 116A-116D of the display window 110.

Figure 21:
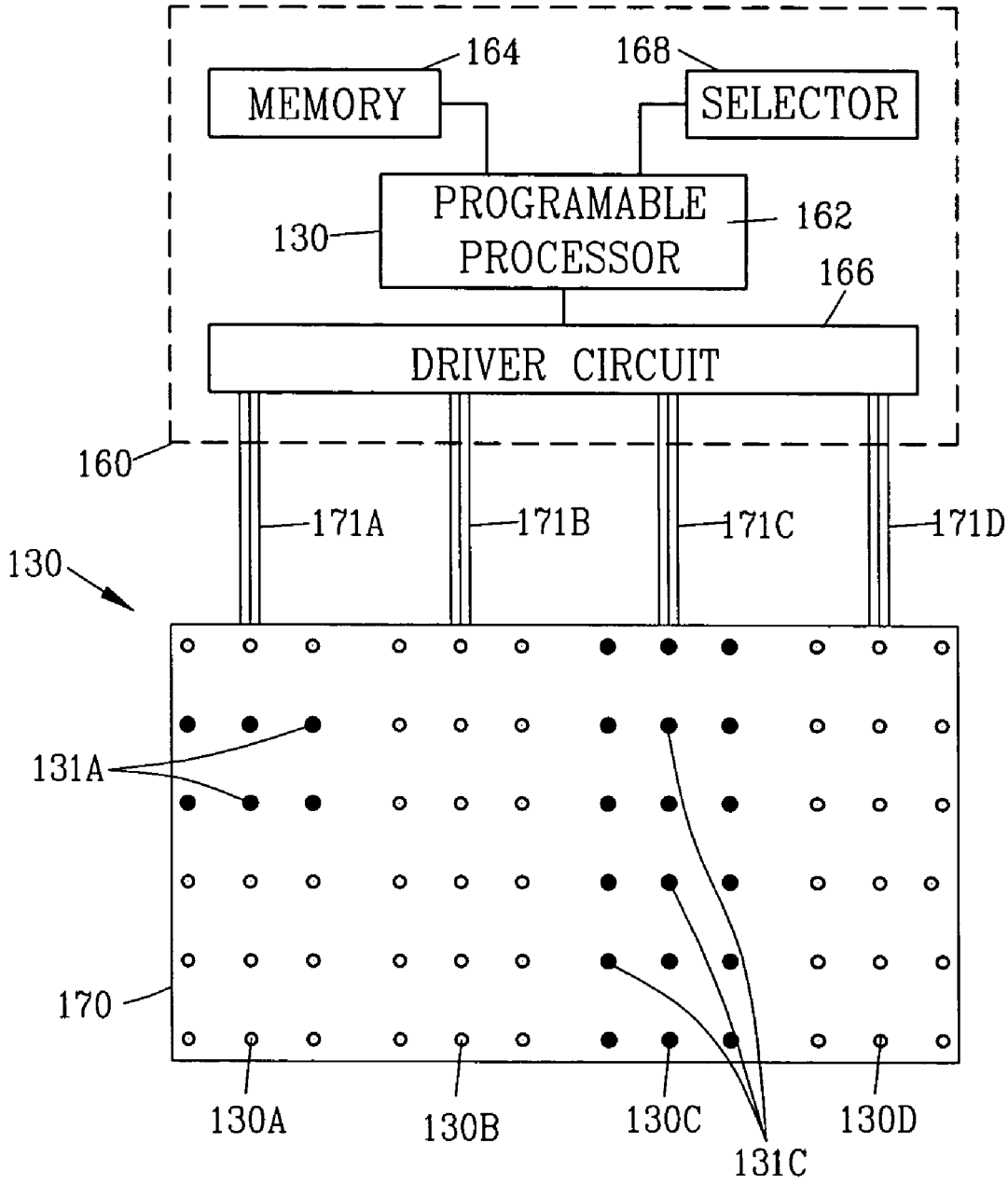
FIG. 21 is a block diagram of the control for energizing the improved display of the present invention.

FIG. 21 is a block diagram of the programmable controller 160 portion of the electrical control 50. The programmable controller 160 energizes the improved display 105 of the present invention. The programmable controller 160 includes a programmable processor 162 for controlling the operation of the plurality of arrays 130A-130D of the multiplicity of solid-state illuminators 131A-131D.

The programmable controller 160 comprises a programmable processor 162 and a programmable memory 164 for storing various illumination sequences or light patterns of the plurality of arrays 130A-130D. A driver circuit 166 receives signals from the programmable processor 162 for actuating the multiplicity of solid-state illuminators 131A-131D of the plurality of arrays 130A-130D. A selector circuit 168 enables an operator to change the illumination sequences or light patterns of the multiplicity of solid-state illuminators 131A-131D.

The multiplicity of solid-state illuminators 131A-131D are mounted on a circuit board 170. The programmable controller 160 may be mounted on an opposed side of the circuit board 170 with the connectors 171A-171D connecting the driver circuit 166 to the plurality of arrays 130A-130D.

The programmable controller 160 is connected to the plurality of switches 22A-22D (not shown) for energizing the multiplicity of solid-state illuminators 131A-131D in response to an actuation of a selected one of the plurality of switches 22A-22D. The multiplicity of solid-state illuminators 131A-131D may energize one or more of multiplicity of solid-state illuminators 131A-131D in response to an actuation of one of the plurality of switches 22A-22D. The programmable controller 160 including the programmable memory 164 determines the specific illumination sequences or light patterns of the multiplicity of solid-state illuminators 131A-131D.

The programmable controller 160 may energize one or more of the multiplicity of solid-state illuminators 131A-131D periodically during non-actuation of the plurality of switches 22A-22D. The periodic energizing of one or more of the multiplicity of solid-state illuminators 131A-131D during non-actuation of the plurality of switches 22A-22D may be use induce sales of the plurality of products 22A-22D.

The programmable controller 160 actuates the multiplicity of solid-state illuminators 131A-131D in response to an actuation of one of the plurality of switches 22A-22D for indicating the dispensing of one of the plurality of processed products 17A-17D by the dispensing machine 105.

A first example of a display pattern of the improved display 105 during an actuation of switch 22A is shown by the solid-state illuminators 131A of the array 130A. In this example, the two rows of solid-state illuminators 131A move or sequence from top to bottom of the array 130A for indicating the dispensing of the processed product 17A.

A second example of a display pattern of the improved display 105 during an actuation of switch 22C is shown by the solid-state illuminators 131C of the array 130C. In this example, all of the solid-state illuminators 131A of the array 130C flash or blink for indicating the dispensing of the processed product 17C. It should be appreciated by those skilled in the art that various other display patterns and/or illumination sequences may be generated by the programmable controller 160.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved display for a dispensing machine, the dispensing machine having a plurality of nozzles for dispensing a plurality of products with a plurality of switches being located adjacent to said plurality of nozzles, comprising:

a display window defined between a first and a second display window end;

a plurality of illuminators located within said display window;

each of said plurality of illuminators comprising a multiplicity of solid-state illuminators arranged in an array located in proximity to each of said plurality of switches, respectively;

a mounting comprising a first and second groove located adjacent to said first and a second display window ends;

a plurality of translucent decorative panels for indicating the types of the plurality of products, respectively;

a flexible transparent lens extending between a first and a second lens end;

said flexible transparent lens having a plurality of sections having a plurality of bars interposed between said plurality of sections;

said plurality of bars defining a plurality of slots for mounting said plurality of translucent decorative panels on said flexible transparent lens;

said first and second lens end of said flexible transparent lens being receivable within said first and second grooves of said mounting for removably mounting said translucent decorative panel in front of said plurality of illuminators for enabling said plurality of illuminators to illuminate through said decorative panel for indicating the types of the plurality of products;

a control comprising a memory for storing an illumination sequence for each of said plurality of illuminators; and a connector interconnecting said control and said plurality of switches and said plurality of illuminators for energizing at least one of said plurality of illuminators with said illumination sequence in response to an actuation of a selected one of said plurality of switches for indicating the dispensing of one of the plurality of products by the dispensing machine.

* * * * *